United States Patent [19]

Kaiser

[11] Patent Number: 4,498,369

[45] Date of Patent: Feb. 12, 1985

[54] HIND ABSORBER FOR AUTOMATIC FIRE-ARMS ACTUATED BY BARREL RECOIL

[75] Inventor: Georges J. L. Kaiser, Chaudfontaine, Belgium

[73] Assignee: Fabrique Nationale Herstal, Belgium

[21] Appl. No.: 469,406

[22] Filed: Feb. 24, 1983

[30] Foreign Application Priority Data

Mar. 19, 1982 [BE] Belgium ..... 2/59636

[51] Int. Cl.[3] ..... F41D 11/12

[52] U.S. Cl. ..... 89/198; 267/9 C

[58] Field of Search ..... 89/130, 177, 198; 188/381; 267/9 R, 9 C

[56] References Cited

U.S. PATENT DOCUMENTS 1,822,079 9/1931 Bull et al. ..... 89/198

*Primary Examiner*—Stephen C. Bentley

*Attorney, Agent, or Firm*—Bacon & Thomas

[57] ABSTRACT

Rear block for automatic fire-arms actuated by the barrel recoil, of the type having a pad associated with a resilient damping and returning mechanism a second damping stage which includes a thrust cone designed to be engaged with the pad during the recoil movement thereof. The cone engages a radially expansible and axially movable ring, which engages a resilient mechanism. The distance separating the said pad from the said cone is adjustable to provide different recoil adsorption characteristics.

4 Claims, 6 Drawing Figures

HIND ABSORBER FOR AUTOMATIC FIRE-ARMS ACTUATED BY BARREL RECOIL

BACKGROUND OF THE INVENTION

The present invention relates to a rear block for an automatic fire-arm actuated by the barrel recoil.

Numerous automatic fire-arms are known, in which the energy necessary to the ejection and the cocking is derived from the recoil of the barrel which is movably mounted for this purpose.

Such fire-arms are equipped with a so-called rear block designed for braking and stopping the barrel at the end of the recoil movement to send it back towards its initial advanced position.

The characteristics proper of said rear block are determining in fact the rate of fire which is a function of the recovery of the barrel recoil energy.

The purpose of the invention is to allow the optimalization of this recovery and, accordingly, the adjustment of the fire rate.

SUMMARY OF THE INVENTION

For this purpose, the invention proposes a rear block of the type comprising a pad associated with a resilient damping and returning means, characterized by a second damping stage comprising a thrust cone designed to be engaged with the said pad during the recoil movement thereof, said cone engaging with a radially expansible and axially movable ring, said ring engaging itself with resilient means, means being provided for adjusting the distance separating the said pad from the said cone.

BRIEF DESCRIPTION OF THE DRAWINGS

For more clarity, the invention will be described hereafter with reference to the purely diagrammatic enclosed drawings in which.

Figure 1:
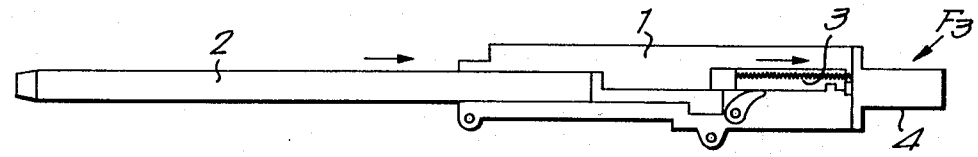
FIGS. 1 and 2 are situating the device according to the invention in a machine-gun the barrel and the moving equipment of which are shown in two characteristic positions.
Figure 2:
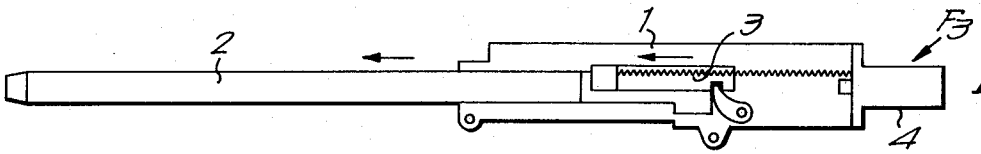

The machine-gun shown in FIGS. 1 and 2 comprises a frame 1 carrying a moving barrel 2 for returning a breech block 3 during its recoil movement (FIG. 1), said moving parts being damped at the end of their travel and then returned forwardly (towards the left of the said figures) through a rear block 4 forming the object of the invention.

Said block 4 consists of a casing 5 (FIG. 3) having two chambers 6 and 7 respectively separated through a partition 8 having a central opening.

In the chamber 6, are disposed spring washers 9 bearing on the said partition 8 and traversed by the rod 10 of a pad 11. Said rod 10 extends into the chamber 7 where it is surrounded with a thrust cone 12 extended with a tail 13 which is itself surrounded with spring washers 14.

The thrust cone 12 engages with a radially expansible braking ring 15. Between the latter and the washers 14, is interposed a bearing washer 16. A threaded plug 17 engages with corresponding threads formed in the wall of the chamber 7.

The washers 9 are forming the first damping stage and the washers 14 are forming the second damping stage.

The device operates as described hereafter.

At the end of the recoil movement (FIG. 1), the breech 3 abuts against the pad 11 which is moved back while compressing the washers 9. After a travel having a length A, a shoulder of the rod 10 of the pad 11 impacts the thrust cone 12. The latter further penetrates the braking ring 15, thereby causing the expansion thereof. As a consequence, the recoil movement of the pad 11 is braked proportionally to the impact.

The delayed action of the ring 15 may be adjusted by adjusting the travel A by means of the plug 17.

Figure 4:
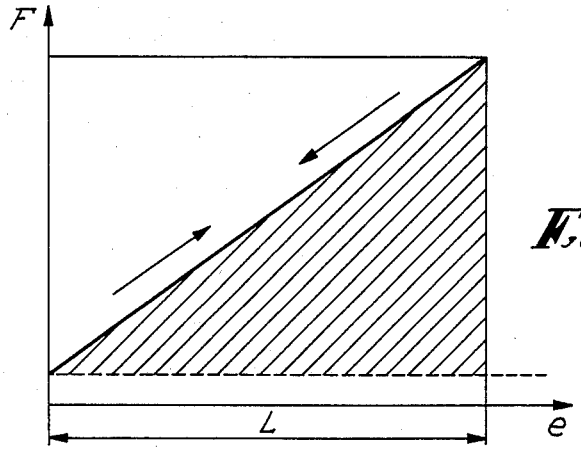
FIGS. 4 to 6 are three diagrams showing the energies recovered and dissipated by rear blocks respectively without braking ring, with a braking ring having a direct action and with a braking ring having a delayed action.

FIG. 4 shows that, without any ring, the absorbed energy would be equal to the recovered energy.

Figure 5:
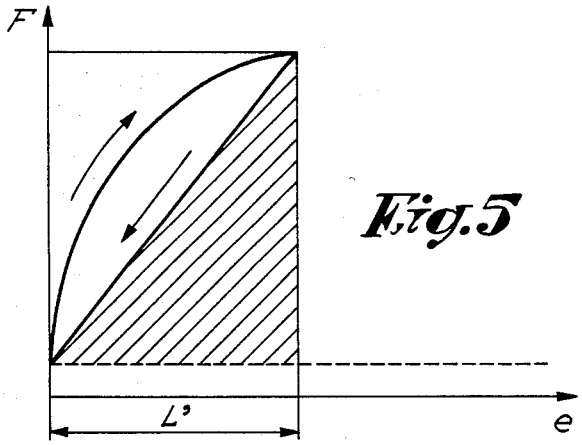

FIG. 5 shows the action of the ring 15 for A equal to zero.

Figure 3:
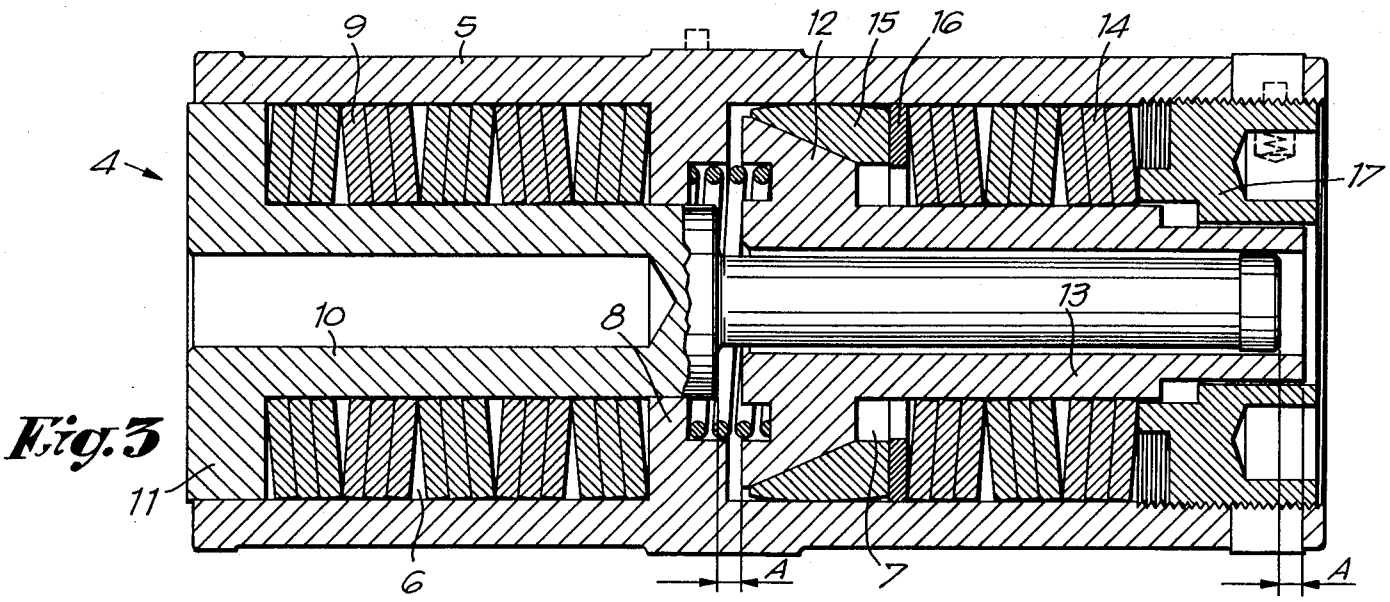
FIG. 3 is an axial section, on a larger scale. of the device according to the invention, as indicated in F3 in FIGS. 1 and 2 at rest.
Figure 6:
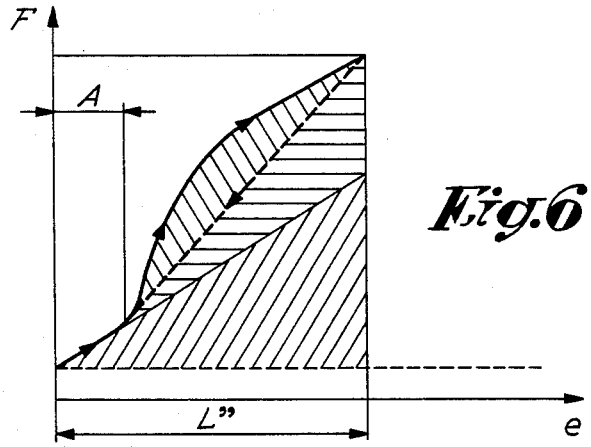

Finally, FIG. 6 shows the functioning of the device represented in FIG. 3. The hatched areas show, from bottom to top, the energy recovered from the first stage (9), the energy recovered from the second stage (14) and, finally, the energy dissipated through the braking ring 15.

In this latter case, during the travel L'-A, the breech block 3 is forwardly propelled (FIG. 2) by the thrust of the pad 11 resulting from the release of the washers 9, as well as by the trust of the cone 12 resulting from the release of the washers 14.

At the end of the return stroke of the cone 15, the action of the washers 9 only is going on. Thus, it is seen that the adjustment of the distance A allows to adjust the total energy restored to the breech block 3. The optimum return speed of the latter ensuring the correct functioning of the fire-arm at the desired rate of fire may be thereby obtained, whatever the elastic characteristics of the support or the mounting of the fire-arm may be. This last characteristic of the invention is particularly important in the practice, e.g. in the case of a machine-gun mounted in a nacelle carried by a helicopter.

It is apparent that the invention is not at all limited to the above described example, it being possible to provide numerous modifications and adaptations within the scope of the following claims.

What I claim is:

1. A rear block for an automatic fire arm comprising: a casing having a longitudinal axis and an interior wall; said interior wall having an inwardly extending portion in a mediate area; a pad slidably positioned within the casing for movement along the axis in response to a recoil force; a front damping stage on one side of the inwardly extending portion comprising front resilient means positioned between an area of the pad and said inwardly extending portion so that said front resilient means is loaded when the pad moves relative to the casing along said axis in one direction and is unloaded when the pad moves relative to the casing in the opposite direction; a rear damping stage on the other side of the inwardly extending portion comprising a thrust cone axially slidable within the casing so that a portion of the thrust cone is engageable with a portion of the pad after the pad is moved an initial distance along said axis, a radially expansible and axially slidable ring engageable with the thrust cone and the interior wall of the casing, rear resilient means engageable with the ring so that said rear resilient means is loaded when the ring moves relative to the casing along said axis in one direction and is unloaded when the ring moves relative to the casing in the opposite direction; adjustment means for adjusting the axial position of the rear damping stage relative to the pad so that said initial distance is variable and whereby the force applied to the pad which is required to begin loading the rear damping stage is variable.

2. A rear block as claimed in claim 1 wherein said pad further comprises a head portion and a rod portion and wherein substantially all portions of the pad are positioned inside the casing.

3. A rear block as claimed in claim 1 further comprising a spring means positionable between said inwardly extending portion and said thrust cone so that the thrust cone is biased against the ring regardless of the value of said initial distance.

4. A rear block as claimed in claim 1 wherein said front resilient means and said rear resilient means are series of spring washers, all of which are in axial alignment and serial arrangement with one another.

* * * * *